US012747528B2

(12) United States Patent
Mehdizadeh Momen

(10) Patent No.: US 12,747,528 B2
(45) Date of Patent: Sep. 29, 2026

(54) COMBO WASHING AND DRYER MACHINE

(71) Applicant: Ultraosnic Technology Solutions, Knoxville, TN (US)

(72) Inventor: Ayyoub Mehdizadeh Momen, Knoxville, TN (US)

(73) Assignee: Ultraosnic Technology Solutions, Knoxville, TN (US)

( * ) Notice: Subject to any disclaimer, the term of this patent is extended or adjusted under 35 U.S.C. 154(b) by 398 days.

(21) Appl. No.: 18/175,992

(22) Filed: Feb. 28, 2023

(65) Prior Publication Data

US 2023/0287616 A1 Sep. 14, 2023

Related U.S. Application Data

(60) Provisional application No. 63/319,110, filed on Mar. 11, 2022.

(51) Int. Cl.
*D06F 19/00* (2006.01)
*D06F 18/00* (2006.01)
*D06F 39/10* (2006.01)

(52) U.S. Cl.
CPC ..... *D06F 19/00* (2013.01); *D06F 18/00* (2013.01); *D06F 39/10* (2013.01)

(58) Field of Classification Search
CPC ..... D06F 19/00; D06F 18/00; D06F 39/10
See application file for complete search history.

(56) References Cited

U.S. PATENT DOCUMENTS

2020/0062428 A1* 2/2020 Freas, II ..... D06F 33/56

FOREIGN PATENT DOCUMENTS

| | | | | |
|---|---|---|---|---|
| CN | 104532510 A | * | 4/2015 | ..... D06F 19/00 |
| CN | 107700143 A | * | 2/2018 | |
| CN | 108457038 A | * | 8/2018 | ..... D06F 19/00 |
| CN | 109295651 A | * | 2/2019 | |

OTHER PUBLICATIONS

Machine translation of CN 104532510 A to Yu. (Year: 2015).*
Machine translation of CN 107700143 A to Liu et al. (Year: 2018).*
Machine translation of CN 108457038 A to Kuang et al. (Year: 2018).*
Machine translation of CN 109295651 A to Wu. (Year: 2019).*

* cited by examiner

*Primary Examiner* — Joseph L. Perrin

(57) ABSTRACT

Disclosed herein is a device for washing and drying clothing. The device may comprise an ultrasonic cleaning module, direct contact ultrasonic dryer modules, a container, a foam and a water capture mechanism. The present invention may also include a direct contact ultrasonic drying plate including: a plurality of holes; a plurality of piezoelectric elements; and an actuator; and a plurality of sensors; and water capture or venting system.

20 Claims, 4 Drawing Sheets

COMBO WASHING AND DRYER MACHINE

FIELD OF THE INVENTION

The present invention relates generally to a clothing washer and dryer. More specifically, a garment or fabric washing and dryer to be used in space or be used on earth.

BACKGROUND OF THE INVENTION

Ultrasonic Technology Solutions (UTS) is based in Tennessee and formed as a spin off start up from Oak Ridge National Laboratory (ORNL). The inventor at ORNL invented the transformative "direct contact ultrasonic drying" back in 2015 at ORNL and improved the technology over five years. In 2020, the lead inventor decided to leave ORNL and focus on the commercialization of this technology at UTS and further improving it UTS exclusively licensed this platform technology from ORNL. The P.I. used to be the Program Manager for HVAC, Appliances, Refrigeration and Water Heating program at ORNL (a $22M R&D portfolio/year). The program goal was to develop the next generation of building equipment technologies for improved comfort and energy efficiency.

The team recently designed a combined clothing washing and drying machine for both commercial and space application. There is a critical need for unique drying technologies in manned space flight as well as generic space applications. For NASA's Life Support and Habitation Systems Focus Area seeks key capabilities and technology solutions that enable extended human presence in deep space and on planetary surfaces such as the moon and Mars, including Orion, ISS, Gateway, Artemis and Human Landing Systems.

One of the critical technological gaps in space applications includes clothing washer/dryer combination for use on the moon (⅙ g) or Mars (⅓ g) that can clean up to 4.5 kg of cotton, polyester, and wool clothing in less than 7 hours using <50 kg machine mass, <0.3 m3 external machine volume and <300 W electrical power (Note: 101.3 kPa habitat pressure may be assumed for prototype development).

Previously, our team demonstrated five times higher drying energy efficiency for clothing (⅕th of the energy input) and two times faster drying rates compared to the state-of-the-art residential clothes dryers. This innovative drying technology was highlighted on more than 350 websites including CNN, BBC, DOE and the prestigious Federal Laboratory Consortium calendar. The technology also showed strong promise for removing water from liquids and semi-liquid materials.

The invention is proposing to develop a transformative combo washing and drying machine for space, residential, commercial and personal use application where the ultrasonic components are the backbone of the technology.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

According to some embodiments, a device for washing and drying clothing is disclosed. The device comprises an ultrasonic cleaning module; direct contact ultrasonic drying module; a container; a foam; a working fluid and the control system. The device can also include a plate including: a plurality of holes; a plurality of piezoelectric elements; plurality of heating elements and actuators.

In some embodiments the present invention may further include a plurality of sensors to measure the pressure of the piezo element on to clothing to improve the effectiveness of overall drying process.

In some embodiments the present invention may further include a plurality of mist or water filters and condenser to separate the mist and vapor from the air.

In some embodiments the present invention may further include a plurality of fans, pumps to move the generated mist away from the system.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

DETAIL DESCRIPTIONS OF THE INVENTION

Figure 1:
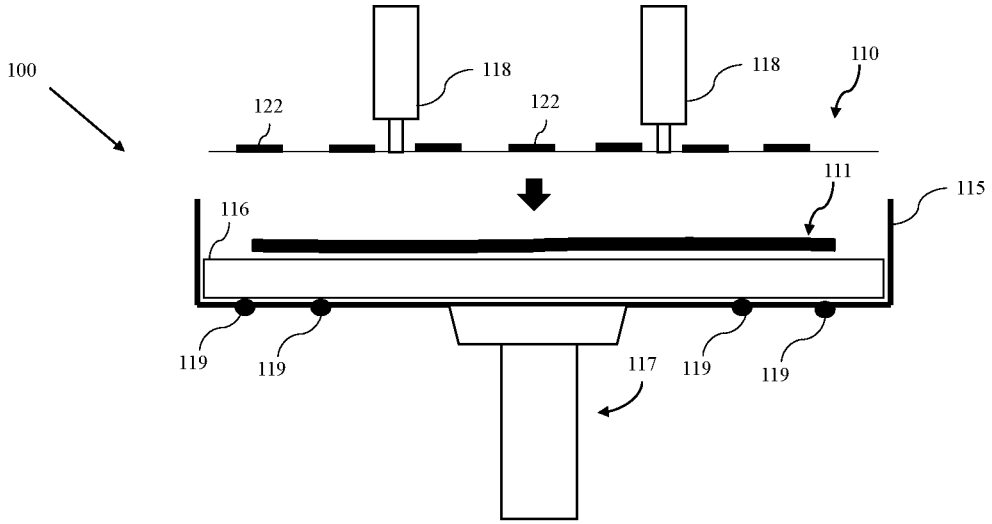
FIG. 1 is an illustration of the present invention.

All illustrations of the drawings are for the purpose of describing selected versions of the present invention and are not intended to limit the scope of the present invention.

Similar to the improvement in quality of life on Earth where technologies such as Electric Lighting, HVAC, Refrigeration, Washer and Dryer Machines, the Vacuum and Water Heating provided a tremendous amount of comfort and improved health to human lives in the previous century, the improvement in human comfort will be essential for the future of space missions. The more Earth-like conditions the inventors can create in space life, the more opportunities the inventors will have to explore space beyond Earth life possibilities.

In a specific example, astronauts must exercise for 2.5 hours each day to keep their health and bone density. Due to weight and volume restrictions, the astronauts don't place their clothes in any washing or drying machine after exercise; instead, astronauts in the ISS have to wear the same exercise clothing about 2-3 times and then discard them in the trash due to significant body odor The inventors imagine this is a big source of discomfort. Conventional heat-based dryers can only remove water ($H_2O$) from fabric, and remaining residues of the body including salt and other micro-organisms that are usually the source of smell will remain on the fabric. Moreover, conventional heat-based dryers may not perform at low gravity conditions as the steam does not rise at zero gravity, inhibiting the evaporation rate (the same goes for water boiling).

Now, if a washing machine needs to be added, not only will the lack of gravity (or low gravity) impact the drying but also a tremendous amount of water and soap is needed for regular washing.

Finally, a regular residential dryer is one of the most energy hungry machines used at home. A residential electric dryer needs 5000-6000 Watts of power during regular operation. More advanced heat pump dryers require half of that but they have their own issues and drawbacks. American's pay more than $12B per year for the energy to run their clothes dryer. Such immense power may not be available beyond Earth. What is obvious is that the solutions the inventors have on Earth will not address the need or won't work in space conditions.

Drying any wet material conventionally using heat and evaporation requires a tremendous amount of energy. Ideally for every 1 kg of water removal, 2200 kJ/kg is required and accounting for all the inefficiencies of regular industrial or residential dryer machines, 3 to 4 times of this is currently required per every 1 kg of water removal. In the case of freeze-drying used for food, fruit and vegetable drying, 20-30 times of this energy is being used.

To dry wet material the inventors took an entirely alternative path. The inventors were inspired by nature when the inventors saw dogs and many other animals shake their body very hard after getting wet. By shaking their skin and fur, animals can mechanically repel a lot of water from their body.

In our process, the inventors are intensifying this by orders of magnitude, where the inventors use piezoelectric elements to shake (vibrate) the wet material very hard at a micron level scale. The extremely high acceleration introduced to the water trapped in the wet material moves it out. This water will migrate toward thousands of small micro holes at the center of our uniquely designed transducers where the immense vibration ejects it out in the form of cold mist. This micro pumping effect is so efficient that the inventors have demonstrated on a regular fabric it can enhance the drying efficiency by 5 times and drying speed by 2 folds in many cases.

Considering that the fundamental mechanism of water removal is surface tension and vibration dependent, gravity does not impact the functionality of the process.

Furthermore, the inventor has identified multiple commercial market that can leverage a combo washing and drying machine. The goal is to develop a transformative combo washer/dryer machine for both commercial and residential application on Earth.

As described above, UTS and its team already invented, developed, and scaled up their transformative ultrasonic drying technology. The inventors are going to use this gravity independent technology for development of the combined washer and dryer machine for future manned space missions as well as supporting life on earth, moon and Mars and beyond. The technology's enormous drying rates not only far exceed the regular residential drying machine, but are also faster compared to industrial drying applications where the process speed is the most valuable. Also, some of the unique high performance exercise fabrics where water does not like to stick to them can be dried much faster than the regular cotton fabric. If the astronauts' fabric can be engineered to have similar properties as the performance athletic fabric, the inventors dried such a fabric on our full scale machine in just 50 seconds, from 200% down to 40%. For this specific performance fabric, a full drying in less than 2 minutes can be achieved! Such a fast drying rate is unheard of in the industry. A regular cotton fabric can fully dry in just 4-5 minutes.

Ultrasonic cleaning Regular washing involves a chemical process where a lot of soap, detergent, and chemicals on top of hot water is being used to disengage dirt, oil, germs from the fabric, and also disinfecting it. During the process a lot of water, detergent and heat is being wasted.

The inventors are proposing to use mechanical washing methods to eliminate the washing cycle. Ultrasonic cleaners have been widely used in the industry for the last several decades.

Considering a free body of water may not be available in many applications including those under zero gravity condition, the inventors need to rely on other mechanisms such as surface tension to hold the water and then introduce significant vibration to the dirty clothes.

The inventors redesigned ultrasonic cleaners for space (or on earth applications) applications and combine it with the ultrasonic dryers. In the smallest form, the machine can have a 30×40 cm cross-sectional area and total weight of less than 3-4 kg.

An astronaut (or a person who lives on the moon or Mars) comes with a dirty piece of garment (shirt, jeans, etc.) and lays it on the foam. The foam is wet or being wet by 200-400 cc of water. The low density foam pores ensure water does not splashing or fly away even under zero gravity conditions. The top assembly (will be explained later) comes down and slowly touches the surface of the garment which is almost soaking wet by now.

The washing cycle starts by turning on the high powered (usually 20-50 kHz) piezoelectric module that is attached to the bottom and exterior of the stainless steel container. Similar to regular ultrasonic cleaners, the vibration of the entire stainless steel will cause the dirt to be mechanically removed from the garment/fabric and float in the water as small particles or solved in water (in the case of salt). This process may only take 2-10 minutes to ensure the maximum cleaning and minimum fabric ageing is achieved.

Now, during the drying cycle, the bottom high powered ultrasonic element will be turned off. And the top assembly system turned on. The top assembly consists of UTS's ultrasonic dryer modules installed on a substrate like carbon fiber, polypropylene, or other materials with many holes. On such a size assembly, 100 to 200 piezos will be installed. The best piezo already identified for the fabric drying under previous activities weighs just 1.23 grams including the wires. Each piezo will consume anywhere between 0.3 to 1.5 Watts depending on applied voltage and the drying speed requirements.

When these piezos are powered by our specialized amplifier, the water and all the dirt inside the water will be ejected upward through small holes on the piezos in the form of cold mist. The entire drying process may take 3 to 9 minutes. The mist can be simply collected by UTS mist filter. The Mars and moon gravities will be a big help to easily guide water. But for ISS and zero gravity conditions, specialized converging micro grooves on these surfaces to assist water movement toward a certain location by leveraging surface tension. At the collection point, the water can be grabbed and pushed through a filter for cleanup and reuse. Once every 20-100 wash cycles, all water in the system may need to be replaced with clean, fresh water.

If larger loads are of interest, these units can be stacked on top of each other. Or alternatively, the washing/drying process can be a batch process. With some engineering work, in the future it may be possible to automate the process.

If certain properties or extreme disinfection is needed, a very minor amount of chemicals and softeners may be added to the water during the process. Note that a regular residential washing machine may need 50 cc (~50 grams) of softener for a full load of laundry, and the whole washing cycle requires 120 to 160 kg of water.

In our proposed system, however, considering water will not be drained, the amount of softener or other chemicals is 2-3 orders of magnitude less than a regular residential washer.

The proposed system is the most compact and most efficient way of washing and drying clothes. The reason the inventors are so sure is that both the washing and drying process happens purely mechanically thus bypasses the latent heat of evaporation or regular chemical process needed during a wash cycle. For a single garment, a 30×40×10 cm assembly should be able to wash and dry a pair of jeans in 6-12 minutes with average power draw of 40 Watts during wash cycle and 30-200 Watts during the drying cycle (depending on the drying speed and eco mode vs. performance mode).

As mentioned before a single fabric dryer piezo including its wires weighs only 1.23 grams (246 grams of piezos for a 200 piezo matrix). The substrate that holds the piezos can be made out of high strength low weight material such as carbon fiber. The amplifier the inventors designed and developed under a previous NASA project weighs only 45.8 grams including all the connections. This amplifier is fairly reliable up to 200 Watts of power output. The inventors believe when the chassis and structures are added, the entire washer/dryer machine can be as light as 3-4 kg. If larger loading is needed, multiple machines can be simply stacked on top of each other.

The proposed technology directly addresses the critical need for a washer/dryer combined system, laid out by NASA under SBIR Topic H03-9, to significantly exceed performance metrics suggested by NASA under this subtopic.

Human sweat itself does not smell. The familiar smell of body odor comes from normal skin bacteria breaking down sweat secretions released from sweat glands. For example, Apocrine glands in the armpits release a thick, oily sweat rich in proteins and lipids. Bacteria on the skin feed on these sweat secretions resulting in body odor. Drying exercise clothing with heat (conventional approach) only evaporates water and leaves the residual salts, organics, bacteria, and resulting bad smell in the fabric.

However, direct contact ultrasonic drying technology alone (excluding washing) can very effectively remove salt water (i.e., human sweat), loosely bonded particles, and oil from exercise clothing of astronauts, reducing odor and extending use of the material.

In addition to improved sanitation, hygiene, and comfort of the astronaut's exercise clothing, significant weight savings from reductions in discarded clothing can result.

Considering that a typical T-shirt weighs about 130 grams, four crew members who dispose of an exercise T-shirt every 2 days for a 1,000-day mission create up to 259 kg (570 lbs) of solid waste.

Our ultrasonic drying process applied to exercise wear drying can reduce the waste of clothing at the ISS by 80% and improve the comfort and quality of life by reducing the odors/germs/bad feeling associated with reusing dirty exercise clothing.

For moon and Mars applications, as described earlier, the proposed technology can offer improved comfort and hygiene.

On land applications, the mainstream, fully commercialized drying technologies include gas based dryers, electric dryers, and heat pump dryers. Food industry freeze dryers are state-of-the-art technologies. Less developed drying technologies include microwave drying and radio frequency drying.

All of the above technologies still fall under evaporative drying which requires a tremendous amount of energy to evaporate water. The proposed technology is mechanical, hence bypassing evaporation and achieving ultimate drying speed and efficiency.

The P.I. and his team recently published a couple of journal papers comparing the efficiency and drying speed of various drying methods.

The direct contact ultrasonic drying technology was invented at ORNL with funding from the DOE. The focus of the DOE projects was on fabric drying (clothes drying applications). In 2018, Ultrasonic Technology Solutions, LLC was formed and exclusively licensed the technology. The exclusivity of the technology license the inventors have from ORNL will provide a competitive edge and help us to commercialize the technology in various fields including space.

In 2020 the P.I. left ORNL to fully dedicate his time to the commercialization activities of this technology. Since then the team not only significantly improved the technology, but also made a 3× reduction in manufacturing cost of the system. The team currently has several joint product development agreements and commercial contracts within the industry. Along the way, the inventors were also privileged to be supported by the NASA.

The lessons learned from the previous R&D activities related to fabric drying was helpful in developing the proposed washing and drying combination machine for space applications.

We are planning to develop a complete washing and drying system prototype and perform a comprehensive performance evaluation. It is expected that the inventors have to go through multiple iterations to refine the process. the inventors are planning to evaluate the beta prototype in available testing facilities, with eventual implementation testing of the prototype on the ISS.

As an additional prime application for moon and Mars applications, the near-term use would be to implement the technology at ISS. Cleaning of astronaut's used exercise clothing will bring significant improvement in comfort and hygiene to ISS. Since there is no laundry in the ISS, exercise clothing also represents a significant form of solid waste. The dirty exercise clothing is discarded after 2-3 uses due to odor, representing ~260 kg (572 lbs) of clothing waste transported back to Earth.

After the inventors have successfully evaluated our technology for use on the ISS and for other NASA applications in general, UTS intends to further develop the technology for consumer use on Earth. The inventors have identified a few direct markets for such a product.

One of the direct markets for such a tabletop size product will be for student housing, dorms, rental properties, hotels, and hospitals.

Based on the previous customer discovery activities UTS performed as well as market analysis the inventors performed under DOE's I-corps program, the inventors found there is a big "pain point" in dorms and student housing. It is very inconvenient for the students to take their clothing to a central laundry location. If there is a local small-scale washer/dryer machine that can address their daily needs and minimize their need to use traditional laundry machines, there would be a good market value for such a product. With some modifications, the prototype the inventors are making for NASA can address such niche markets after the product is commercialized.

Another niche market for such a product will be personal use in hotels and beaches. A lot of people who are taking vacations to beaches come back to their hotels or vacation homes with wet clothing. Usually there is no in-house dryer available. A small lightweight drying machine that can be powered by a cigarette outlet in the car or powered inside the hotel room will be appealing for the markets.

On a much smaller scale a battery powered, handheld washing and drying system for baby clothing emergency cleanup might be another potential market into which the inventors can look.

Last but not least, a lot of developing countries do not have access to reliable electricity and their existing grid infrastructure cannot handle the power requirements of the type of generic dryer the inventors use here in the States. A low power, small scale washer and dryer machine can significantly improve the comfort and quality of life in such environments.

Figure 2:
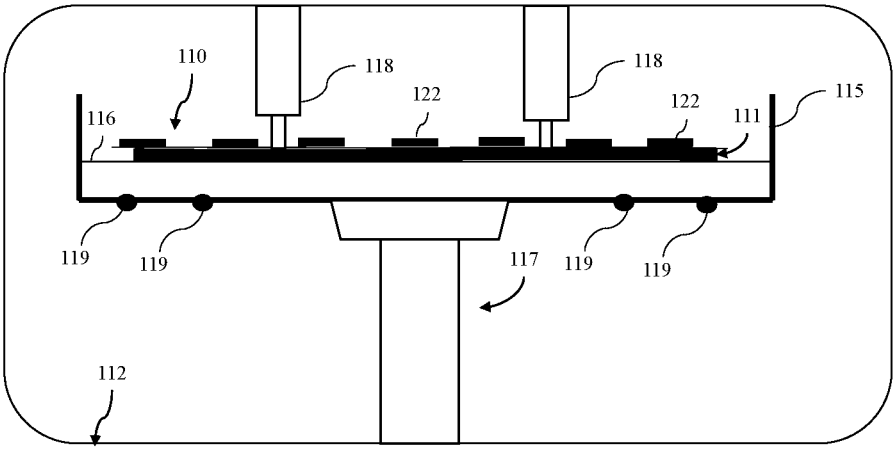
FIG. 2 is an illustration of the present invention with the piezoelectric module pressed down against the clothing.
Figure 3:
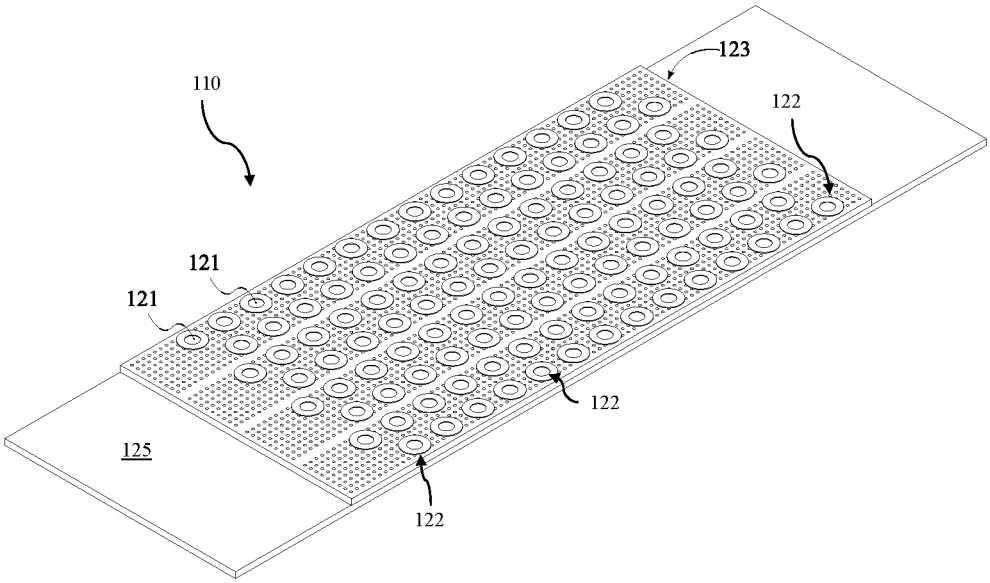
FIG. 3 is an illustration of one embodiment of the piezoelectric module of the present invention.

As shown in FIGS. 1 to 3, the present invention provides a device 100 comprising an ultrasonic cleaning module 117, a foam 116, a container 115, a piezoelectric module 110, a plurality of actuators 118, a housing 112, a plurality of sensors 119, a water capture filtration module 130.

The ultrasonic cleaning module 117 can be any known module that works through high-frequency sound waves transmitted through liquid to scrub clean the surface of immersed parts. The high-frequency sound waves agitate the liquid solution of water or solvent, and cause the cavitation of solution molecules.

The foam 116 can be a very low density foam (such as polyurethane, for example) used for zero gravity conditions. In some embodiments, the present invention can be used without the foam 116 for earth gravity conditions.

The container 115 can be of any shape and size. The container 115 may include any suitable material include stainless steel.

In one embodiment, the ultrasonic cleaning module 117 can be attached at the bottom of the container 115 and the foam 116 can be positioned in the container 115 between the plate 125 (also called a direct contact ultrasonic drying plate) and the container 115.

The piezoelectric module 110 may include a plurality of piezoelectric elements 122.

A piezoelectric element 122 is known in the art and include an electromechanical transducer manufactured from piezoelectric materials of a certain shape, piezoelectric element 122 can convert electrical energy into mechanical energy and mechanical into electrical energy.

Some examples of piezoelectric materials are PZT (also known as lead zirconate titanate), barium titanate, and lithium niobate. If a piezoelectric element 122 is attached to a structure, it can be strained as the structure deforms and part of the vibration energy can be converted into electrical energy.

In one embodiment, the piezoelectric module 110 may include a plate 125 (also called a direct contact ultrasonic drying plate) on which the piezoelectric element 122 can be placed, wherein the piezoelectric element 122 can include many micro holes at the center of the piezoelectric element 121.

In one other embodiment, the plurality of sensors 119 can be placed underneath the plate 125 (also called a direct contact ultrasonic drying plate) and the piezoelectric module 110 may be placed on top of the plate.

In some embodiments, the plate 125 (also called a direct contact ultrasonic drying plate) may include conductive material traces to act like a heater when the electric current passing through the system/device 100.

In one embodiment, a plurality of holes 123 can be spaced one the plate 125 (also called a direct contact ultrasonic drying plate). As a result, the plurality of holes 123 and piezoelectric center holes 121 ensures liquid can pass through from the wet material and into the present invention.

The plurality of holes 123 has a cylindrical shape. In an alternative embodiment the plurality of holes 123 can be designed with a cylindrical or conical shape.

In some embodiments, the present invention may include a plurality of amplifiers circuit board and a plurality of PCB boards which can be known in the art. Each of the PCB boards may receive DC voltage from the plurality of amplifiers and convert it to high frequency power to drive the plurality of piezoelectric elements 122.

In reference to FIG. 3, the plurality of piezoelectric elements 122 is a disk shape. In an alternative embodiment the piezoelectric elements 122 can be designed with a large continuous perforated plate with plurality of piezoelectric elements 122 attached to the back of the perforated plate. Accordingly, the plurality of piezoelectric elements 122 vibrates easily at a high frequency shaking the wet material placed on the piezoelectric module 110. In an alternative embodiment the plurality of piezoelectric elements 122 can be designed with a ring, tape, rectangular, square, plate or circle shape.

In some embodiments, the plurality of piezoelectric elements (piezo element) 122 can be electrically connected to any known amplifiers which are powered by a power source. Thus, the plurality of piezoelectric elements 122 vibrates at a high frequency when power is provided from the amplifier circuit boards which are powered by power source which may be any power source known in the art.

The power source may produce a single pole, bi-polar oscillating voltage, or a burst width modulating oscillating voltage. The power source may provide a sinusoidal, square, ramp or variation thereof of voltage. In some embodiments, the power source may send multiple pulses at the resonance frequencies of the plurality of piezoelectric elements 122 and give a pause for a certain period to help improve efficiency.

The power source may seek the resonance frequency during the operation and find the best operating frequency.

The actuator 118 may include a linear motor, an electric motor, a DC motor, an AC motor, a linear actuator, an electric actuator. The actuator 118 may be configured to move the piezoelectric module up and down inside the container so that the piezoelectric module 110 can be properly attached to or detached from the garment/clothing 111.

In some embodiments, the actuator 118 can be a manual actuator or an automatic actuator that can be operated manually or automatically. For example, the device 100 can be configured so that the actuator 118 can be automatically operated when the washing cycle is started or completed. In one embodiment, the actuator 118 may be placed on top of the plate 125 (also called a direct contact ultrasonic drying plate).

In some other embodiments, the present invention may include a housing 112 to enclose all the components.

In some embodiments, the device 100 of the present invention may include a plurality of sensors 119 to measure the pressure of the piezo element 122 on to clothing 111 so that clothing 111 can be properly pressured without damaging or improve the effectiveness of overall drying process. Such sensors 119 may include pressure sensors, magnetic induction sensors, acoustic sensors, laser sensors, LIDAR, a variety of image sensors, and the like. The pressure sensors may include a force sensor, force sensitive resistor, mechanical sensor, load sensor, load cell, strain gauge, piezo sensor, membrane potentiometer, or any other suitable pressure sensors. These sensors can be attached to any suitable location of the device.

The water capture filtration module (heat exchanger) 130 may include a plurality of fins 132 and a fan 131. In some embodiment, the water capture filtration module 130 can be connected to the piezoelectric module 110 and/or a thermoelectric module 133. The connection of the water capture filtration module 130 to the piezoelectric module 110 can include any suitable connections that allows the water capture filtration module 130 to operate with the piezoelectric module 110. For example, the fan 131 can be directly attached to piezoelectric module 110 and the plurality of fins 132 can be attached to the fan 131. In some embodiments, the plate 125 can be connected to any kind of water capture filtration module enclosure that may include the fan 131 and the fins 132 of the water capture filtration module 130. The plate 125 may also include the water capture filtration module (heat exchanger) 130, in some embodiments.

Figure 4:
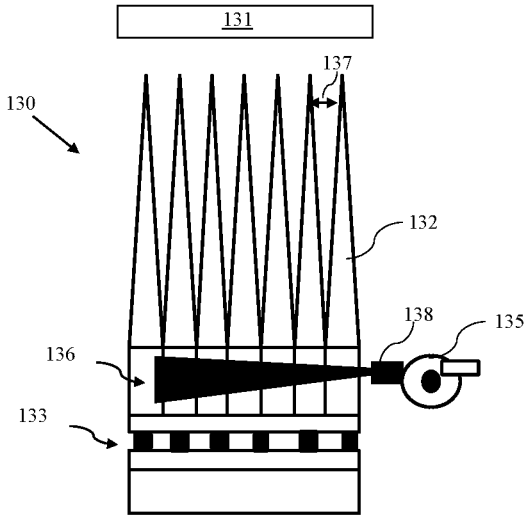
FIG. 4 is an illustration of one embodiment of the water capture filtration module of the present invention.

In some embodiments, where the water capture is important, a simple fan 131 can be used to carry the water droplets and vapor out of the system/device 100 of the present invention as seen in FIG. 4. In more complex systems, such as those under zero gravity condition, as the water is extracted in the form of mixed mist and vapor from piezoelectric module 110, a fan 131 and any piping system that may be connected to the fan 131 conduct the moist air toward a cold heat exchanger or a cold side of the thermoelectric module (or a heat pump) 133 while the power is adjusted to ensure the temperature of thermoelectric module 133 or the system/device 100 is below the dew point. During ground testing, water is collected on this heat exchanger, and pure water dips down to a container 136 underneath. The cold side heat exchanger 130 is based on capillary system and wedged fin with tapered angles 137 of ~15 degrees. Water will be collected and, due to surface tension, travel downward to the root of the fins 132. A microchannel header 138 is designed to connect this trapped water to a pump 135 that will pull the water out.

In some embodiments, the present invention may include the water capture filtration module (heat exchanger) 130 as an optional feature. For example, the device 100 may include a container 136; an ultrasonic cleaning module 117 attached to the container 136; a foam 116 removable attached to the container 136; a plate 125 (also called a direct contact ultrasonic drying plate) removably connected to the container 136 including: a plurality of holes 123; a plurality of piezoelectric elements 122 positioned on the plate 125 (also called a direct contact ultrasonic drying plate); and an actuator 118 connected to the plate 125 (also called a direct contact ultrasonic drying plate); and a plurality of sensors 119 placed on the container 136; and a water capture filtration module 130 having a plurality of fins 132 and a fan 131.

Although the invention has been explained in relation to its preferred embodiment, it is to be understood that many other possible modifications and variations can be made without departing from the spirit and scope of the invention.

The following is claimed:

1. A device for washing and drying clothing comprising a container;

an ultrasonic sonic cleaning module attached to the container, the ultrasonic cleaning module configured to transmit high-frequency sound waves through a liquid solution to agitate the liquid and cause cavitation of solution molecules;

a direct contact ultrasonic drying plate removably connected to the container, the direct contact ultrasonic drying plate including:

a plurality of holes spaced thereon;

a plurality of piezoelectric elements positioned on the direct contact ultrasonic drying plate, wherein the piezoelectric elements vibrate at a high frequency to shake wet material placed on the direct contact ultrasonic drying plate; and an actuator connected to the direct contact ultrasonic drying plate and configured to move the piezoelectric elements up and down inside the container; and a plurality of sensors placed on the direct contact ultrasonic drying plate or the container, wherein the sensors measure the pressure of the piezoelectric elements on clothing to improve the effectiveness of the drying process.

2. The device as claimed in claim 1, further includes a foam placed in the container.

3. The device as claimed in claim 1, wherein the sensors are load sensors attached to the container.

4. The device as claimed in claim 1, wherein the actuator is a manual actuator attached to the top of the direct contact ultrasonic drying plate.

5. The device as claimed in claim 1, wherein the actuator is an automatic actuator attached to the top of the direct contact ultrasonic drying plate.

6. The device as claimed in claim 1, further comprising a housing configured to enclose the device.

7. The device as claimed in claim 1, wherein the sensors include pressure sensors attached to the side of the container.

8. The device as claimed in claim 1, further includes a water capture filtration module having a plurality of fins and a fan, the water capture filtration module is connected to the plurality of piezoelectric elements and configured to collect and reuse condensed water during the washing and drying cycles.

9. A device for washing and drying clothing comprising a container;

an ultrasonic sonic cleaning module attached to the container, the ultrasonic cleaning module configured to transmit high-frequency sound waves through a liquid solution to agitate the liquid and cause cavitation of solution molecules;

a foam removably attached to the container, the foam positioned between the direct contact ultrasonic drying plate and the container;

a direct contact ultrasonic drying plate removably connected to the container, the direct contact ultrasonic drying plate including:

a plurality of holes spaced thereon, wherein the plurality of holes and piezoelectric center holes ensure liquid can pass through from wet material into the device;

a plurality of piezoelectric elements positioned on the direct contact ultrasonic drying plate, wherein the piezoelectric elements vibrate at a high frequency when powered by an amplifier circuit board; and an actuator connected to the direct contact ultrasonic drying plate;

a plurality of sensors placed on the container, wherein the sensors measure the pressure of the piezoelectric elements on clothing; and a water capture filtration module having a plurality of fins and a fan, the water capture filtration module is connected to the direct contact ultrasonic drying plate and configured to conduct moist air toward a heat exchanger while extracting water vapor and mist from the device.

10. The device as claimed in claim 9, wherein the container is a rectangular container.

11. The device as claimed in claim 9, wherein the sensors include pressure sensors attached to the side of the container.

12. The device as claimed in claim 9, wherein the sensors include load sensors attached to the side of the container.

13. A device for washing and drying clothing comprising a container;

an ultrasonic sonic cleaning module attached to the container, the ultrasonic cleaning module configured to transmit high-frequency sound waves through a liquid solution at a frequency of 20 kHz to 50 kHz to agitate the liquid and cause cavitation of solution molecules;

a direct contact ultrasonic drying plate removably connected to the container, the direct contact ultrasonic drying plate including:

a plurality of holes spaced thereon;

a plurality of piezoelectric elements positioned on the direct contact ultrasonic drying plate, wherein the piezoelectric elements convert electrical energy into mechanical energy to vibrate at high frequency; and an actuator connected to the direct contact ultrasonic drying plate and configured to move the piezoelectric elements up and down to attach to or detach from clothing; and a plurality of sensors placed on the direct contact ultrasonic drying plate or the container, wherein the sensors include pressure sensors, load sensors, or force sensors configured to measure pressure of the piezoelectric elements on clothing.

14. The device as claimed in claim 13, further includes a foam placed in the container.

15. The device as claimed in claim 13, wherein the sensors are load sensors attached to the container.

16. The device as claimed in claim 13, wherein the actuator is a manual actuator attached to the top of the direct contact ultrasonic drying plate.

17. The device as claimed in claim 13, wherein the actuator is an automatic actuator attached to the top of the direct contact ultrasonic drying plate.

18. The device as claimed in claim 13, further comprising a housing configured to enclose the device.

19. The device as claimed in claim 13, wherein the sensors include pressure sensors attached to the side of the container.

20. The device as claimed in claim 13, further includes a water capture filtration module having a plurality of fins and a fan, the water capture filtration module is connected to the plurality of piezoelectric elements and configured to collect moisture and recycle water during the washing operation.

* * * * *